US006229271B1

(12) United States Patent
Liu

(10) Patent No.: US 6,229,271 B1
(45) Date of Patent: May 8, 2001

(54) LOW DISTORTION LINE DIMMER AND DIMMING BALLAST

(75) Inventor: Guang Liu, Lake Zurich, IL (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 09/512,173

(22) Filed: Feb. 24, 2000

(51) Int. Cl.[7] ..... G05F 1/00

(52) U.S. Cl. ..... 315/291; 315/194; 315/225; 315/DIG. 4

(58) Field of Search ..... 315/291, 307, 315/DIG. 4, 209 R, 225, 194, 247; 323/222, 283; 363/39–41, 89, 98, 124; 327/172, 175

(56) References Cited

U.S. PATENT DOCUMENTS 4,797,599 * 1/1989 Ference et al. ..... 315/194
5,107,184 4/1992 Hu et al. ..... 315/291
5,264,823 11/1993 Stevens ..... 340/310 A
5,371,439 * 12/1994 Griffin ..... 315/209 R
5,404,094 * 4/1995 Green et al. ..... 323/282
5,455,490 10/1995 Callahan et al. ..... 315/194
5,457,360 10/1995 Notohamiprodjo et al. ..... 315/219
5,539,281 7/1996 Shackle et al. ..... 315/224
5,557,174 * 9/1996 Johler ..... 315/194
5,691,605 * 11/1997 Xia et al. ..... 315/307
5,872,429 2/1999 Xia et al. ..... 315/194

* cited by examiner

*Primary Examiner*—Haissa Philogene
(74) *Attorney, Agent, or Firm*—Carlo S. Bessone

(57) ABSTRACT

A line dimmer has a limited maximum firing angle to limit a total harmonic distortion within a powering signal. A dimming ballast generates a pulse width modulated signal based on a firing angle of the powering signal, generates a dimming command signal based on the pulse width modulated signal, and dims a lamp based on the dimming command signal. The maximum firing angle may be limited to 30 degrees, 25 degrees, or 20 degrees, for example, to limit a resulting total harmonic distortion.

19 Claims, 8 Drawing Sheets

LOW DISTORTION LINE DIMMER AND DIMMING BALLAST

TECHNICAL FIELD

The present invention relates to dimmable ballast systems.

BACKGROUND OF THE INVENTION

In today's dimmable fluorescent lighting market, a number of different methods are used for dimming control. One popular method for dimming control employs a dimmer control interposed between a power line and an input of a dimming ballast. The dimming control comprises a phase-control device, such as a triac, to modify a firing phase angle of an alternating current (AC) powering signal. A dimming ballast circuit, in turn, controllably dims a fluorescent lamp based on the firing phase angle.

In some applications, the aforementioned dimming control approach yields an undesirably-high total harmonic distortion (THD) and an undesirably-low power factor. The high THD is caused by the chopping action of the triac. As a result, applications of the aforementioned dimming control approach have been limited.

U.S. Pat. No. 5,872,429 discloses use of coded perturbations in the line signal to obtain a lower THD. An encoder encodes a command over a command period of several cycles in the line signal. The encoder encodes the command by selectively injecting perturbations near zero-crossings of specific cycles in the command period. A controller within a ballast detects the perturbations over the command period, and decodes the command. The perturbations may be injected only when a change of light level is needed.

SUMMARY OF THE INVENTION

The present invention provides a dimming ballast apparatus including a firing-angle-to-pulse-width-modulation converter to generate a pulse width modulated signal based on a firing angle of a powering signal. The firing angle is less than or equal to 30 degrees. A filter generates a dimming command signal based on the pulse width modulated signal. A method is also disclosed which includes generating a pulse width modulated signal based on a firing angle of a powering signal wherein the firing angle is less than or equal to 30 degrees, generating a dimming command signal based on the pulse width modulated signal, and dimming a lamp based on the dimming command signal.

BRIEF DESCRIPTION OF THE DRAWINGS

The invention is pointed out with particularity in the appended claims. However, other features of the invention will become more apparent and the invention will be best understood by referring to the following detailed description in conjunction with the accompanying drawings in which:

DETAILED DESCRIPTION OF PREFERRED EMBODIMENTS

Embodiments of the present invention beneficially provide a low THD line dimmer and dimming ballast which require neither a multi-cycle command encoder within the line dimmer nor a multi-cycle command decoder within the ballast. In contrast, the THD is reduced by limiting the maximum firing angle produced by the line dimmer.

Figure 1:
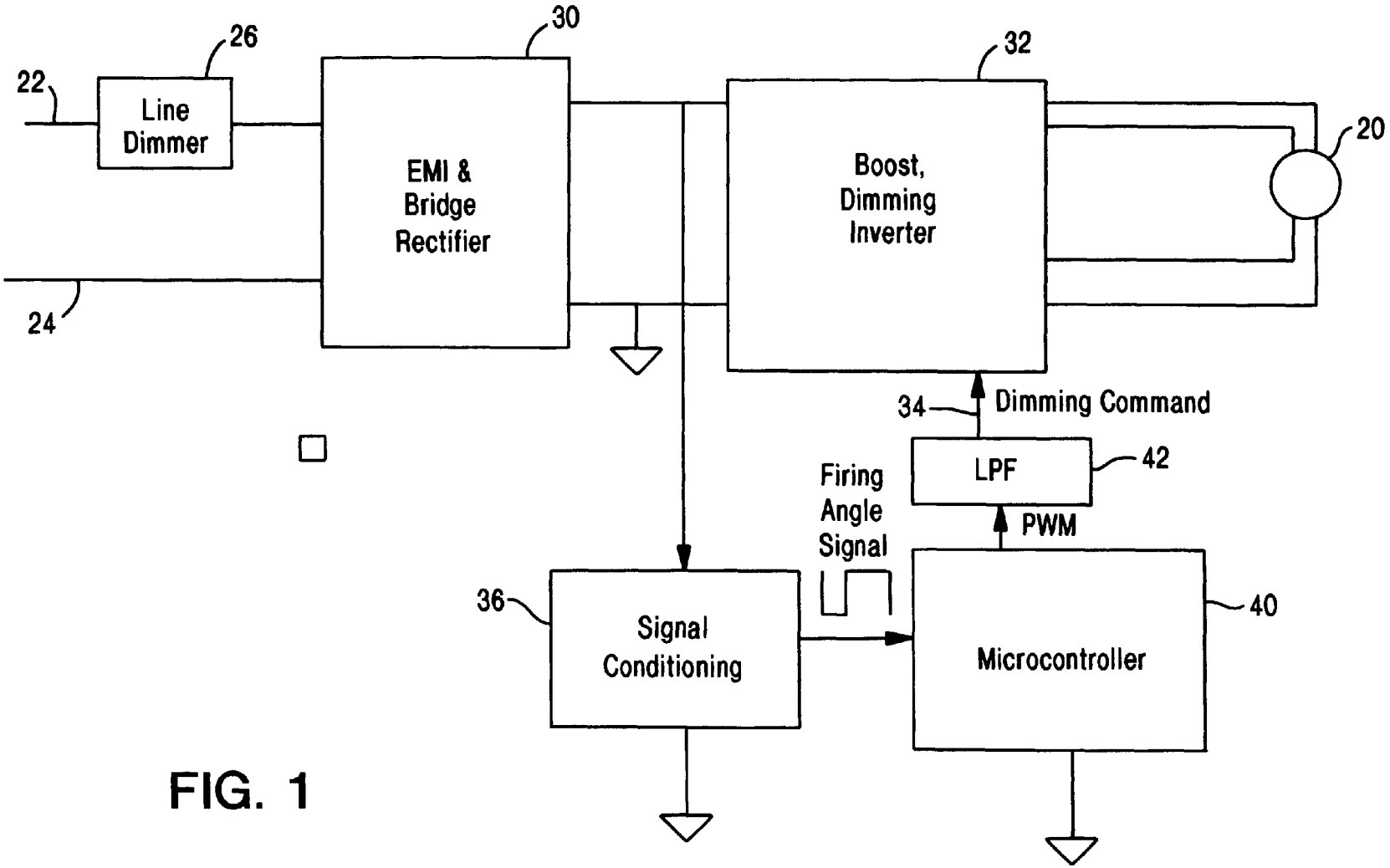
FIG. 1 is a block diagram of an embodiment of a dimming system for dimming a lamp.

FIG. 1 is a block diagram of an embodiment of a dimming system for dimming a lamp 20. Preferably, the lamp 20 comprises a discharge lamp, such as a compact fluorescent lamp or another fluorescent lamp. The dimming system receives mains power from AC power lines 22 and 24. The AC power lines 22 and 24 may be referred to as either "HOT" and "NEUTRAL" respectively, or "SUPPLY" and "COMMON" respectively.

A line dimmer 26 is coupled to the AC power line 22 to provide a power-line-type control for dimming the lamp 20. The line dimmer 26 varies a firing angle of a phase-cut powering signal to encode a dimming-control signal therein. The dimming system dims the lamp 20 based on the firing angle. An embodiment of the line dimmer 26 is subsequently described with reference to FIG. 2.

An EMI (electromagnetic interference) filter and bridge rectifier stage 30 is coupled to an output of the line dimmer 26 and the AC power line 24. The EMI filter and bridge rectifier stage 30 provides a filtered and rectified AC signal to a boost, dimming inverter circuit 32 coupled thereto. The boost, dimming inverter circuit 32 is for controlling and powering the lamp 20 based upon power received from the EMI filter and bridge rectifier stage 30 and a dimming command signal received from an input 34.

A signal conditioner 36 processes the filtered and rectified AC signal from the EMI filter and bridge rectifier stage 30 to generate a firing angle signal. A firing-angle-to-pulse-width-modulation (PWM) converter 40 generates a pulsed signal whose pulse width is modulated based on the firing angle of the firing angle signal.

A filter 42, such as a low pass filter, is responsive to the firing-angle-to-PWM converter 40. The filter 42 produces a signal having a DC voltage level related to the pulse width of the pulsed signal generated by the firing-angle-to-PWM converter 40. The signal from the filter 42 is applied to the input 34 to provide a dimming command signal. The boost, dimming inverter circuit 32 dims the lamp 20 based on the dimming command signal. Therefore, the signal conditioner 36, the firing-angle-to-PWM converter 40, the filter 42 and the boost, dimming inverter 32 cooperate to dim the lamp 20 based on the firing angle produced by the line dimmer 26.

Figure 2:
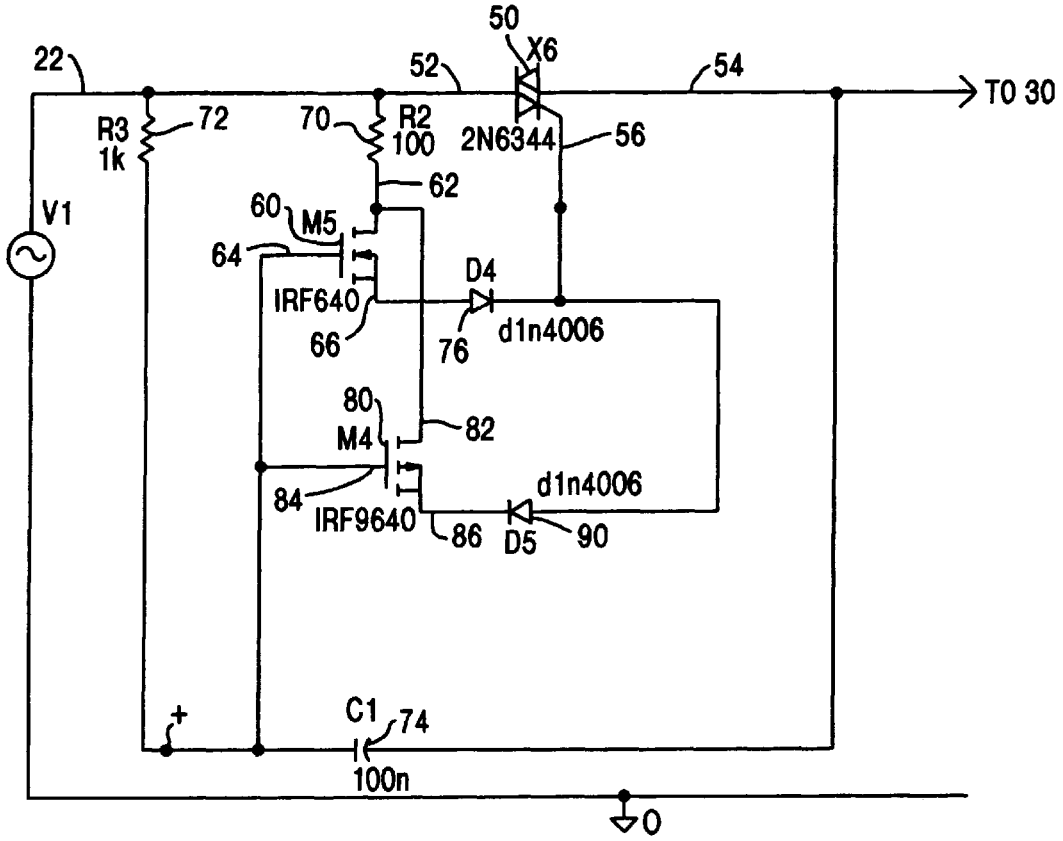
FIG. 2 is a schematic diagram of an implementation of the line dimmer of FIG. 1.

FIG. 2 is a schematic diagram of an implementation of the line dimmer 26 of FIG. 1. A triac 50 has a first terminal 52 coupled to the AC power line 22 and a second terminal 54 coupled to the EMI and bridge rectifier stage 30. The triac 50 electrically couples the AC power line 22 with the EMI and bridge rectifier stage 30 for a first portion of an AC cycle, and substantially uncouples the AC power line 22 with the EMI and bridge rectifier stage 30 for a second portion of an AC cycle. The firing angle, i.e. the angle of the second portion, is controllable via a gate 56 of the triac 50.

A transistor 60, such as an n-channel MOSFET, has drain 62, a gate 64 and a source 66. The drain 62 is coupled to the first terminal 52 by a resistor 70. The gate 64 is coupled to the first terminal 52 by a resistor 72. The gate 64 is coupled to the second terminal 54 by a capacitor 74. The source 66 is coupled to the gate 56 of the triac 50 by a diode 76. The diode 76 has an anode coupled to the source 66 and a cathode coupled to the gate 56.

A transistor 80, such as a p-channel MOSFET, has drain 82, a gate 84 and a source 86. The drain 82 is coupled to the first terminal 52 by the resistor 70. The gate 84 is coupled to the first terminal 52 by the resistor 72. The gate 84 is coupled to the second terminal 54 by the capacitor 74. The source 86 is coupled to the gate 56 of the triac 50 by a diode 90. The diode 90 has a cathode coupled to the source 86 and an anode coupled to the gate 56.

The triac 50 turns off, i.e. substantially uncouples the first terminal 52 from the second terminal 54, near each zero crossing of an AC cycle. With the triac 50 off after a zero up-crossing, the capacitor 74 is charged based upon a voltage difference between the first terminal 52 and the second terminal 54. When the capacitor 74 charges such that the gate-to-source voltage of the transistor 60 is greater than or equal to a threshold voltage, the transistor 60 supplies current from the source 66 to the gate 56 of the triac 50 via the diode 76. This current causes the triac 50 to turn on, i.e. to couple the first terminal 52 with the second terminal 54.

The first terminal 52 and the second terminal 54 remain coupled until near a zero down-crossing. Near the zero down-crossing, the triac 50 uncouples the first terminal 52 from the second terminal 54. With the triac 50 off after a zero down-crossing, the capacitor 74 is charged based upon a voltage difference between the first terminal 52 and the second terminal 54. When the capacitor 74 charges such that the gate-to-source voltage of the transistor 80 is less than or equal to a threshold voltage, the transistor 80 sinks current at the source 86. This current flows to the source 86 from the gate 56 of the triac 50 via the diode 90. This current causes the triac 50 to turn on, i.e. to couple the first terminal 52 with the second terminal 54.

The aforementioned implementation of the line dimmer 26 varies a firing angle within a small range to limit a resulting line current distortion. Preferably, the firing angle for a minimum load condition is less than or equal to about 30 degrees. To further reduce a resulting line current distortion, the firing angle for a minimum load condition may be less than or equal to about 25 degrees. To still further reduce a resulting line current distortion, the firing angle for a minimum load condition may be less than or equal to about 20 degrees.

The firing angle for a full load condition may be less than or equal to about 10 degrees. Alternatively, the firing angle for a full load condition may be less than or equal to about 5 degrees. As another alternative, the firing angle for a full load condition may be about 0 degrees.

Figure 3:
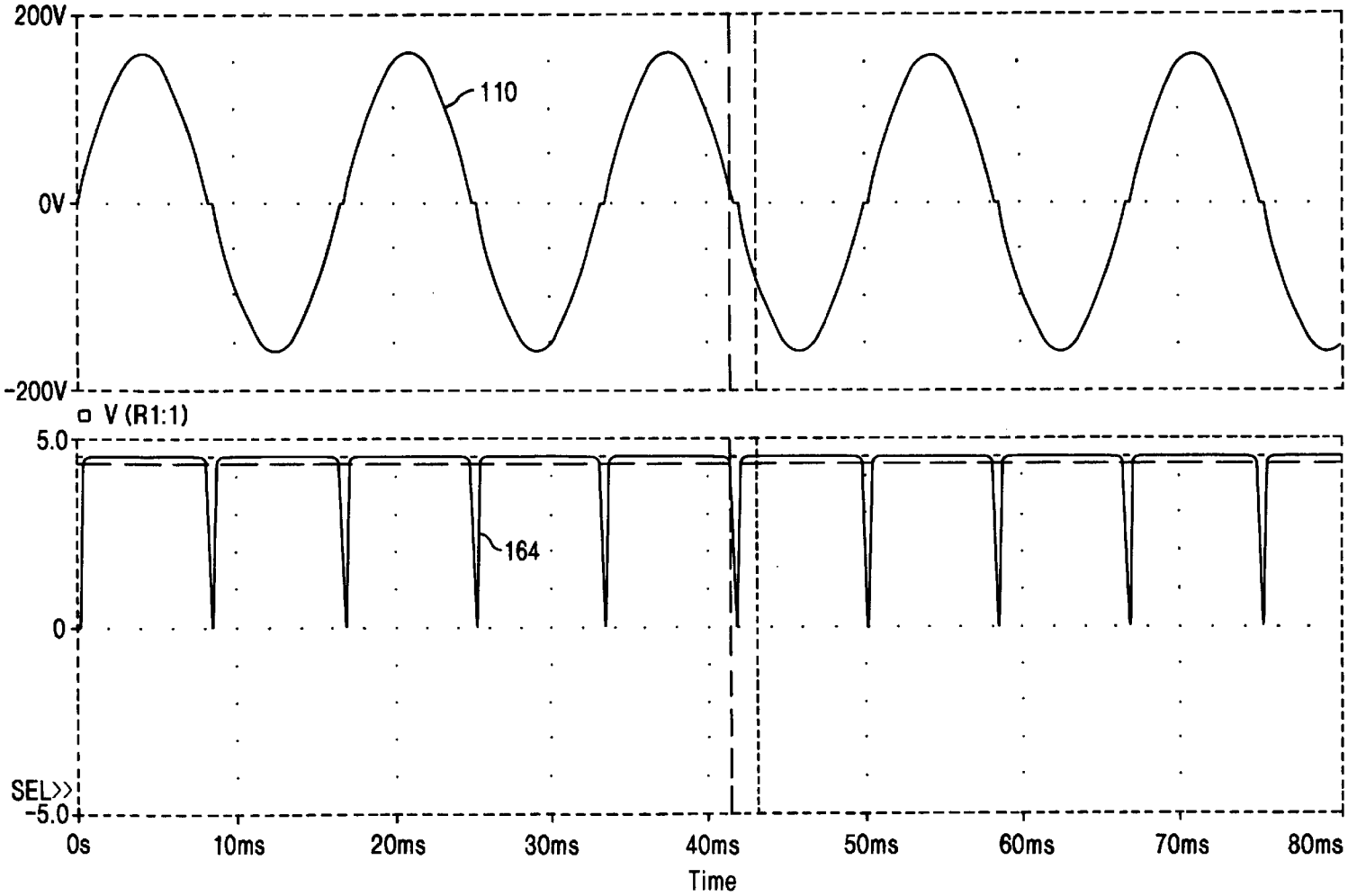
FIG. 3 shows example waveforms produced for a full load condition.
Figure 4:
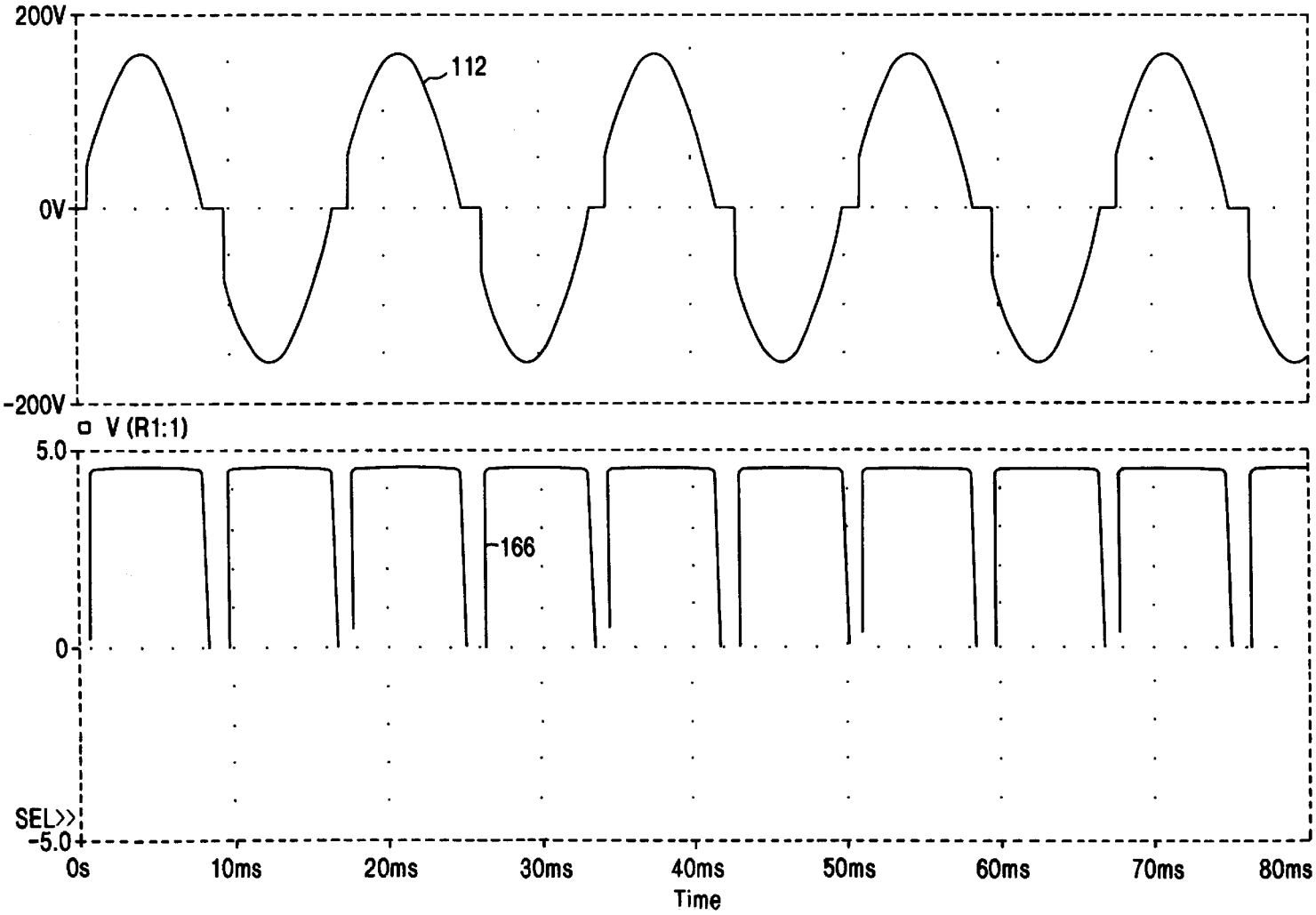
FIG. 4 shows example waveforms produced for a minimum load condition.

FIG. 3 shows an example waveform 110 produced at the second terminal 54 for a full load condition. FIG. 4 shows an example waveform 112 produced at the second terminal 54 for a minimum load condition.

Figure 5:
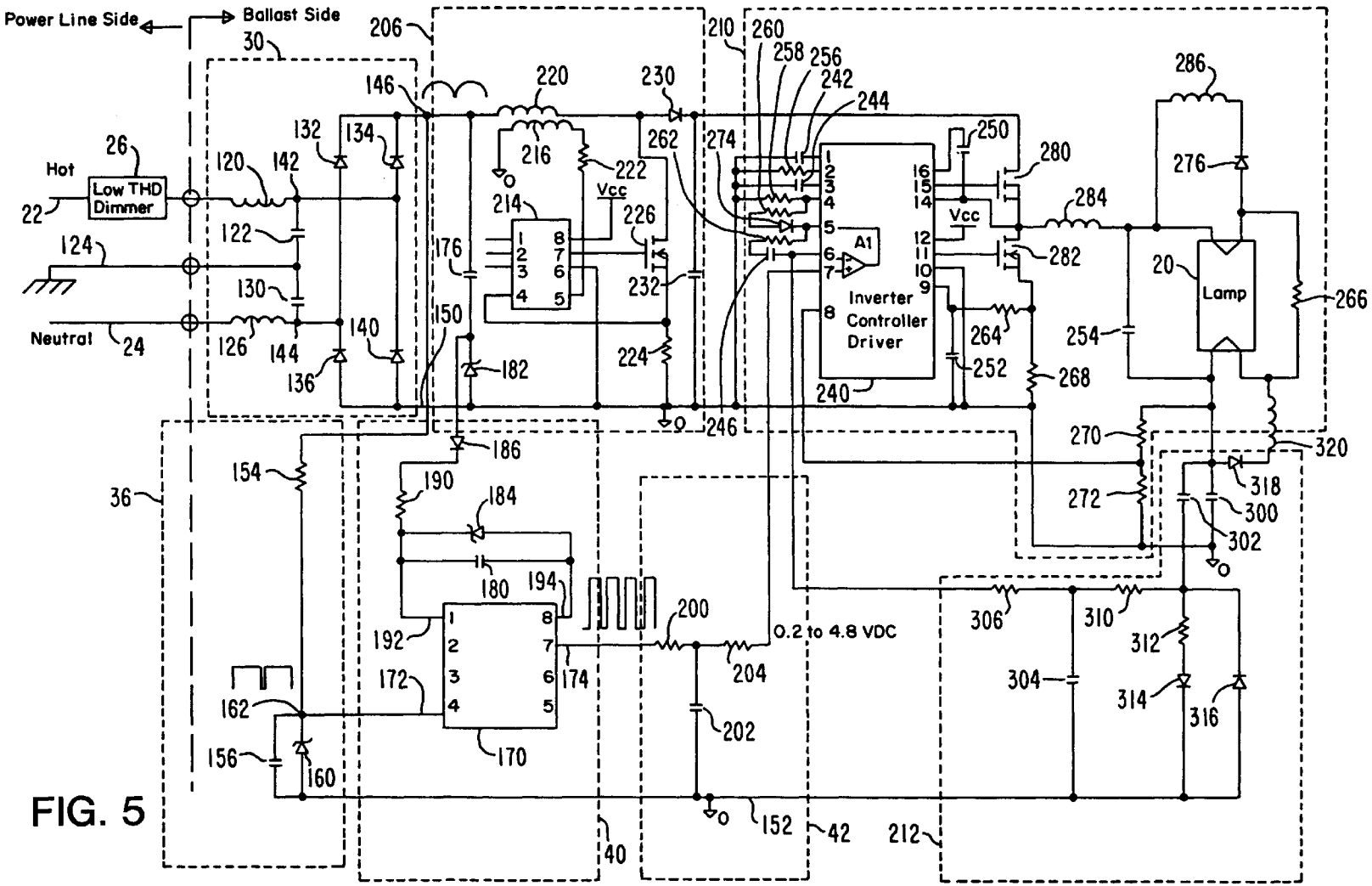
FIG. 5 is a schematic diagram of an implementation of a dimming system for dimming the lamp.

FIG. 5 is a schematic diagram of an implementation of a dimming system for dimming the lamp 20. The EMI filter and bridge rectifier stage 30 comprises a series combination of an inductor 120 and a capacitor 122 which couples the line dimmer 26 to ground 124. A series combination of an inductor 126 and a capacitor 130 couples the AC power line 24 to ground 124. Diodes 132, 134, 136 and 140 are configured as a bridge rectifier. The bridge rectifier is coupled to a junction 142 of the inductor 120 and the capacitor 122 and to a junction 144 of the inductor 126 and the capacitor 130. The bridge rectifier has outputs 146 and 150. The output 150 is coupled to a ballast-side ground 152.

The signal conditioner 36 comprises a resistor 154, a capacitor 156 and a Zener diode 160. The resistor 154 couples the output 146 to a juncture 162. A parallel combination of the capacitor 156 and the Zener diode couples the juncture 162 to the ballast-side ground 152.

At the juncture 162, the signal conditioner 36 generates a pulsed signal having a high level when the triac 50 is on, and a low level when the triac 50 is off. FIG. 3 shows an example waveform 164 produced at the juncture 162 for a full load condition. FIG. 4 shows an example waveform 166 produced at the juncture 162 for a minimum load condition.

Referring back to FIG. 5, the firing-angle-to-PWM converter 40 comprises a microcontroller 170. The microcontroller 170 has an input 172 coupled to the juncture 162. The microcontroller 170 is programmed to convert a firing angle received at the input 172 to a pulse width modulated signal provided at an output 174. Preferably, the microcontroller 170 determines a duration of a low period of a pulsed signal at the input 172. At the output 174, the microcontroller 170 generates a pulsed signal having a pulse width based on the duration. The pulse width is inversely related to the duration. Thus, if the duration of the low period is at a lower value, such as zero, the pulse width at the output 174 is based on a maximum pulse width value. If the duration of the low period is at an upper value, the pulse width at the output 174 is based on a minimum pulse width value. It is noted that in alternative embodiments, the microcontroller 170 may determine a duration of a high period of a pulsed signal at the input 172, and generate a pulsed signal having a pulse width directly related, i.e. non-inversely related, to the duration.

Power is supplied to the microcontroller 170 by a voltage supply circuit comprising capacitors 176 and 180, Zener diodes 182 and 184, a diode 186 and a resistor 190. A series combination of the capacitor 176 and the Zener diode 182 couples the output 146 to the output 150. The junction of the capacitor 176 and the Zener diode 182 is coupled to a voltage supply input 192 of the microcontroller 170 by a series combination of the diode 186 and the resistor 190. A parallel combination of the capacitor 180 and the Zener diode 184 couples the voltage supply input 192 to the ballast-side ground 152. A ground input 194 of the microcontroller 170 is coupled to the ballast-side ground 152.

The output 174 is coupled to an input of the filter 42. The filter 42 comprises a resistor 200 and a capacitor 202 which form a low-pass filter. The filter 42 outputs a signal having a DC level based on the pulse width of the signal generated by the firing-angle-to-PWM converter 40. The input 34 of the boost, dimming inverter circuit 32 is responsive to the filter 42 via a resistor 204.

The boost, dimming inverter circuit 32 comprises a power factor correction (PFC) stage 206, an inverter and output stage 210, and a lamp current sensing circuit 212. The PFC stage 206 comprises an integrated circuit 214 such as one having part number MC33262, windings 216 and 220, resistors 222 and 224, a transistor 226, a diode 230, and a capacitor 232. The inverter and output stage 210 comprises an inverter controller driver integrated circuit 240, capacitors 242, 244, 246, 250, 252 and 254, resistors 256, 258, 260, 262, 264, 266, 268, 270 and 272, diodes 274 and 276, transistors 280 and 282, and inductors 284 and 286. The lamp current sensing circuit 212 comprises capacitors 300, 302 and 304, resistors 306, 310 and 312, diodes 314, 316 and 318, and inductor 320.

Figure 6:
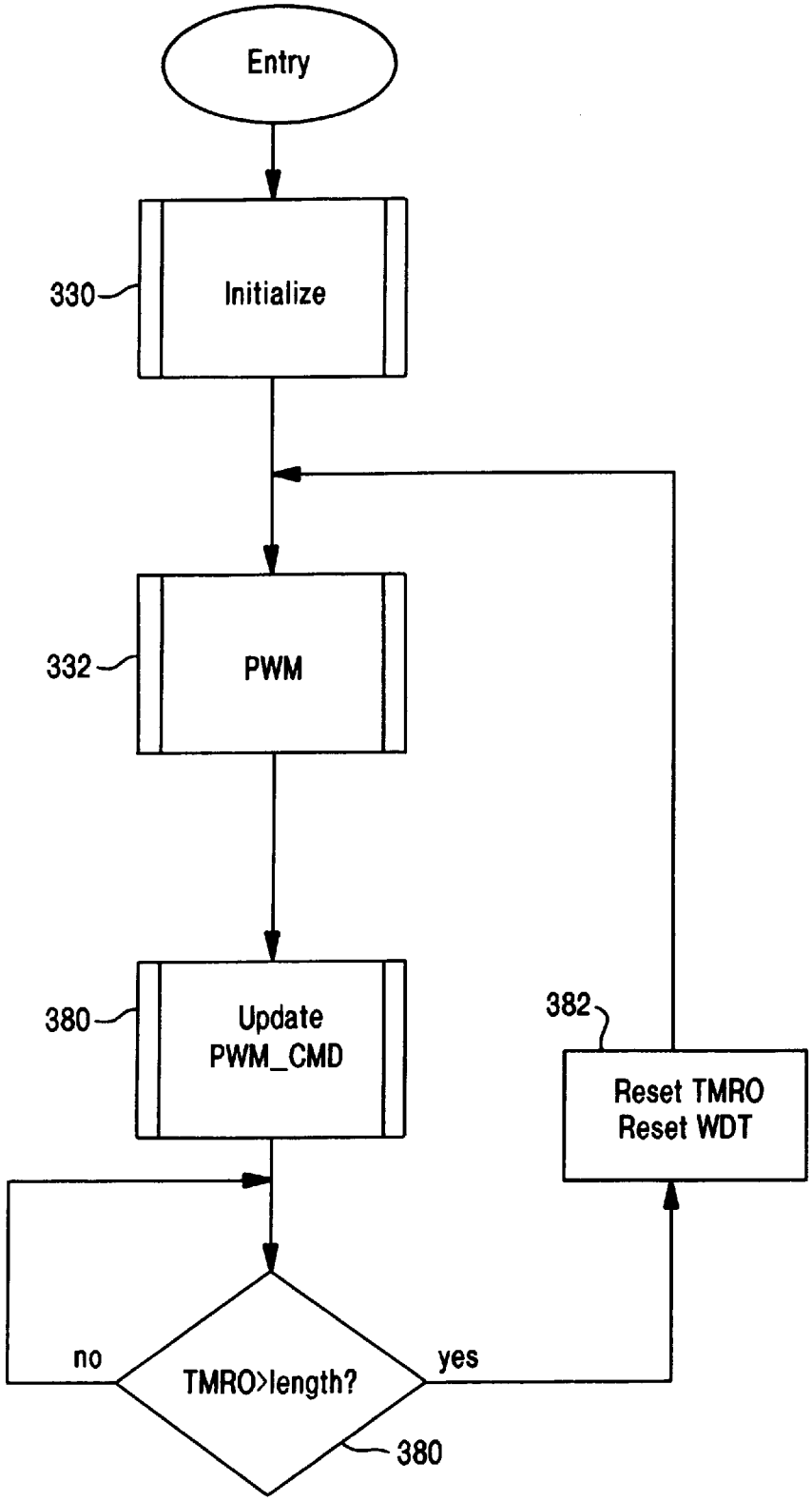
FIG. 6 is a flow chart of a main routine performed by the microcontroller to convert a pulsed signal at the input to a pulse-width modulated signal at the output.

FIG. 6 is a flow chart of a main routine performed by the microcontroller 170 to convert a pulsed signal at the input 172 to a pulse-width modulated signal at the output 174. As indicated by block 330, the microcontroller 170 performs an initialization routine. In the initialization routine, the microcontroller 170 configures the input/output pins, sets an option register, sets a PWM_CMD variable to a maximum value such as 10, sets a PERIOD value to a value such as 31, sets a LENGTH value to a value such as 88, sets a CMD_COUNT variable to an initial value such as 0, sets a STEP_COUNT variable to an initial value such as 0, sets an INP_PRE variable to high (i.e. a logical "1"), and clears a timer value TMR0.

The STEP_COUNT variable is used to count a number of steps in an output period. The PERIOD value is used to determine when to initiate a subsequent output period based on the STEP_COUNT variable. The LENGTH value is used to represent a number of instruction cycles, as determined by the timer value TMR0, per step. The PWM_CMD variable indicates a number of steps that a PWM output signal has a high value. The CMD_COUNT variable is used to count a number of steps that the input 172 has a low value. The INP_PRE variable indicates a state of the input 172 in a previous step.

Figure 7:
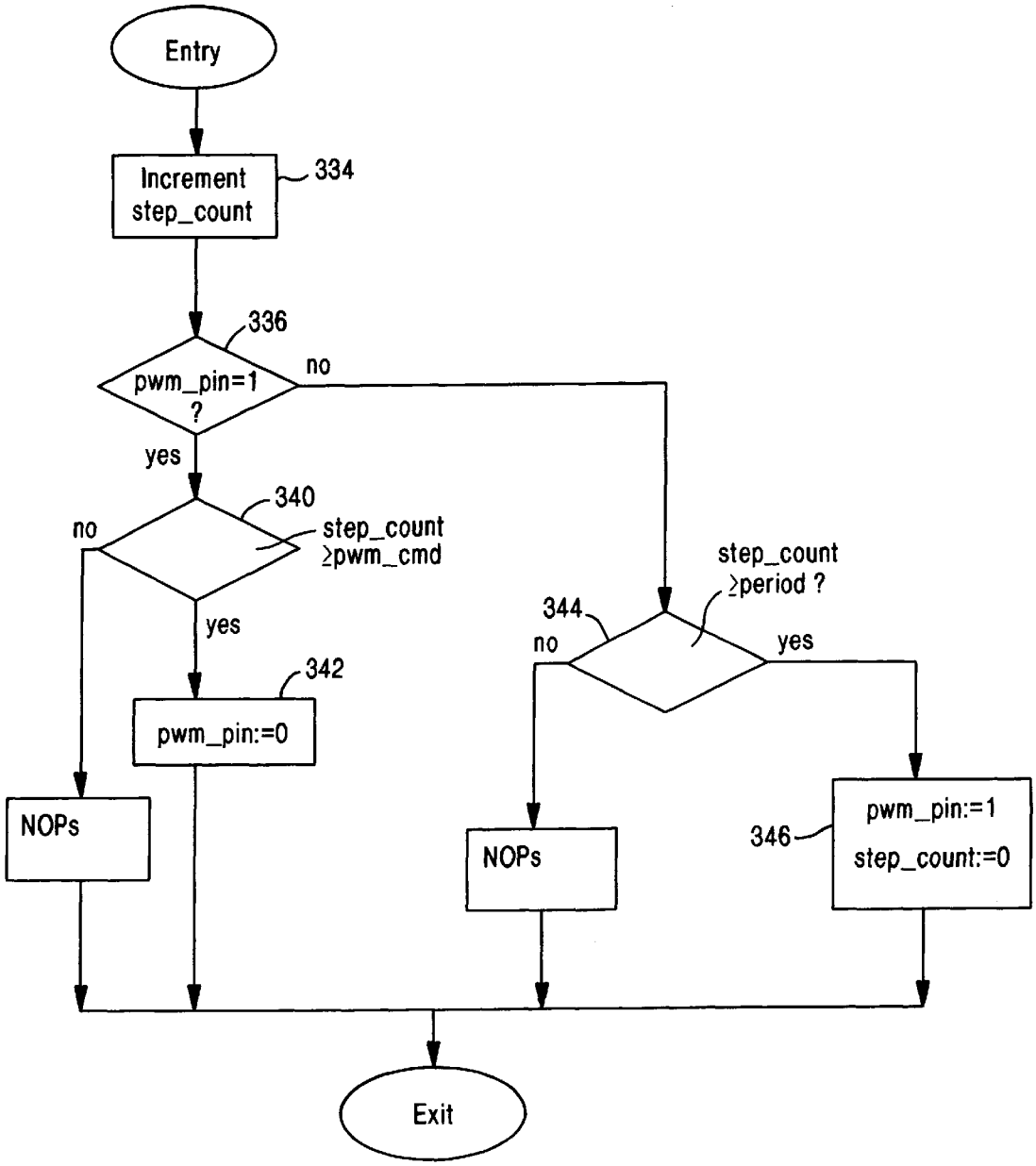
FIG. 7 is a flow chart of a preferred embodiment of a method of performing the PWM routine.

As indicated by block 332, the microcontroller 170 performs a PWM routine. In the PWM routine, the microcontroller 170 determines a next value of a PWM output signal based on a present value of the PWM output signal, the STEP_COUNT value, the PWM_CMD value, and the PERIOD value. The state of the PWM output signal is herein denoted by a variable PWM_PIN. FIG. 7 is a flow chart of a preferred embodiment of a method of performing the PWM routine.

As indicated by block 334, the microcontroller 170 increments the STEP_COUNT value. As indicated by block 336, the microcontroller 170 determines if the present PWM_PIN state is high (a logical "1") or low (a logical "0"). If the present PWM_PIN state is high, the microcontroller 170 determines if the STEP_COUNT value is greater than or equal to the PWM_CMD value (as indicated by block 340). If the STEP_COUNT value is greater than or equal to the PWM_CMD value, the PWM_PIN value is set to low (i.e. a logical "0"), as indicated by block 342. The acts indicated by blocks 334, 336, 340 and 342 cooperate to produce an output signal having a high value for a duration based on the PWM_CMD value.

Referring back to block 336, if the present PWM_PIN state is low, the microcontroller 170 determines if the STEP_COUNT value is greater than the PERIOD value (as indicated by block 344). If so, the microcontroller 170 sets the PWM_PIN state to high (i.e. a logical "1") and resets the STEP_COUNT value to an initial value such as zero, as indicated by block 346. The acts indicated by blocks 334, 336, 344 and 346 cooperate to produce an output signal having a period based on the PERIOD value.

Figure 8:
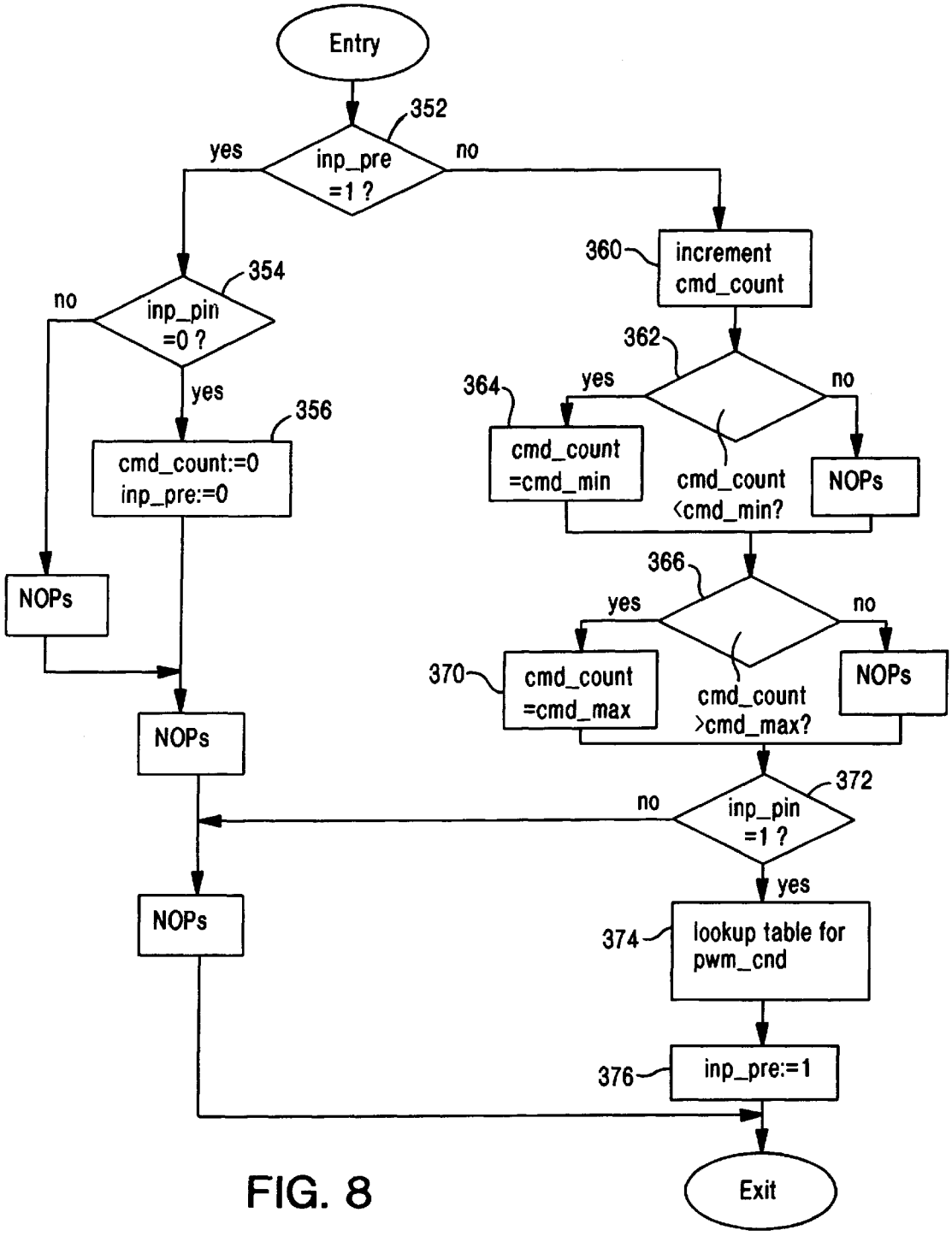
FIG. 8 is a flow chart of a preferred embodiment of a method of performing the PWM_CMD updating routine.

Referring back to FIG. 6, the microcontroller 170 performs a routine to determine whether to update the PWM_CMD value (as indicated by block 350). FIG. 8 is a flow chart of a preferred embodiment of a method of performing the PWM_CMD updating routine.

As indicated by block 352, the microcontroller 170 determines if the INP_PRE value is equal to 1, i.e. if the previous state of the input 172 is high. If so, the microcontroller 170 determines if the present state of the input 172, denoted by the variable INP_PIN, is equal to 0 (as indicated by block 354). If so, as indicated by block 356, the CMD_COUNT variable is reset to an initial value such as zero, and the INP_PRE value is set to 0.

Referring back to block 352, if the INP_PRE value is 0, the microcontroller 170 increments the CMD_COUNT variable, as indicated by block 360. As indicated by block 362, the microcontroller 170 determines if the CMD_COUNT variable is less than a lower bound denoted by CMD_MIN. If so, the microcontroller 170 sets the CMD_COUNT variable to CMD_MIN, as indicated by block 364. Preferably, CMD_MIN is equal to zero.

As indicated by block 366, the microcontroller 170 determines if the CMD_COUNT variable is greater than an upper bound denoted by CMD_MAX. If so, the microcontroller 170 sets the CMD_COUNT variable to CMD_MAX, as indicated by block 370. Preferably, CMD_MAX is equal to 53.

As indicated by block 372, the microcontroller 170 determines if the present state of the input 172, denoted by the variable INP_PIN, is equal to 1. If so, as indicated by block 374, the microcontroller 170 determines a value for PWM_CMD based on the CMD_COUNT value. Preferably, the value for PWM_CMD is determined using a lookup table.

In one embodiment, the value for PWM_CMD is constant for a lower range of CMD_COUNT values, linearly decreasing for an intermediate range of CMD_COUNT values, and constant for an upper range of CMD_COUNT values. For example, the constant value for the lower range may be 31, the constant value for the upper range may be 0, and the values for the intermediate range may decrease (either linearly or logarithmically) from 31 to 0.

As indicated by block 376, the microcontroller 170 sets the INP_PRE value to 1, and returns to the main routine in FIG. 6. Referring back to FIG. 6, the microcontroller 170 determines if the timer value TMR0 has exceeded the LENGTH value, as indicated by block 380. If not, the act indicated by block 380 is repeated. After the timer value TMR0 has exceeded the LENGTH value, the timer value TMR0 is reset to an initial value such as zero and a watchdog timer (WDT) is reset, as indicated by block 382. Thereafter, flow of the routine is directed back to block 332. The acts indicated by blocks 380 and 382 cooperate to ensure that the PWM routine in block 332 is repeatedly performed at equal time intervals.

Using the herein-disclosed methods, the microcontroller 170 is capable of detecting a small change in firing angle, and generating a pulse-width modulated signal based thereupon. The pulse-width modulated signal is filtered by the filter 42 to produce an analog dimming command signal, which may range from 0.2 VDC to 4.8 VDC for example. The analog dimming command signal is usable by conventional dimming ballasts to dim the lamp 20. Since the firing angle is varied within a small range, the resulting THD is improved across a full lighting range of the lamp 20.

Optionally, the microcontroller 170 may provide an option pin to select between a low THD line dimmer such as one described herein, or a conventional line dimmer having a greater range of firing angles. Here, depending on whether a signal to the option pin is low or high, the microcontroller 170 may perform an alternative method for a conventional line dimmer in contrast to the herein-described method for a low THD line dimmer.

Thus, there has been described herein several embodiments including a preferred embodiment of a low distortion line dimmer and dimming ballast.

It will be apparent to those skilled in the art that the disclosed invention may be modified in numerous ways and may assume many embodiments other than the preferred form specifically set out and described above. For example, in alternative embodiments, some pairs of components may be indirectly coupled rather than being directly coupled as in the preferred form. Therefore, the term "coupled" as used herein is inclusive of both directly coupled and indirectly coupled. By indirectly coupled, it is meant that a pair of components are coupled by one or more intermediate components. Further, alternative phase-control dimmers may be substituted for the herein-disclosed phase-cut triacs.

Accordingly, it is intended by the appended claims to cover all modifications of the invention which fall within the true spirit and scope of the invention.

What is claimed is:

1. A dimming ballast apparatus comprising:

a firing-angle-to-pulse-width-modulation converter to generate a pulse width modulated signal based on a firing angle of a powering signal from a power-line phase angle dimmer control, wherein the firing angle of each half cycle of the powering signal from the power-line phase angle dimmer control is less than or equal to 30 degrees; and a filter to generate a dimming command signal based on the pulse width modulated signal.

2. The dimming ballast apparatus of claim 1 wherein the firing angle is less than or equal to 25 degrees.

3. The dimming ballast apparatus of claim 1 wherein the firing angle is less than or equal to 20 degrees.

4. The dimming ballast apparatus of claim 1 further comprising a dimming inverter circuit responsive to the dimming command signal from the filter.

5. The dimming ballast apparatus of claim 1 further comprising a signal conditioner to generate a pulsed firing angle signal based on the powering signal, wherein the firing-angle-topulse-width-modulation converter is responsive to the pulsed firing angle signal.

6. The dimming ballast apparatus of claim 5 wherein the firing-angle-to-pulse-width-modulation converter comprises a microcontroller to determine a duration of a portion of the pulsed firing angle signal, and to generate the pulse width modulated signal having a pulse width based on the duration.

7. The dimming ballast apparatus of claim 6 wherein the duration is of a low period of the pulsed firing angle signal.

8. The dimming ballast apparatus of claim 7 wherein the pulse width is inversely related to the duration.

9. The dimming ballast apparatus of claim 5 wherein the firing-angle-to-pulse-width-modulation converter comprises a microcontroller having an input responsive to the signal conditioner and an output to produce the pulse width modulated signal, the microcontroller operative to:

(a) initialize a first value for counting a number of steps in an output period, a second value for determining when to initiate a subsequent output period, a third value for representing a number of instruction cycles per step, a fourth value for indicating a number of steps that the output is to be high, a fifth value for counting a number of steps that the input is high, a sixth value for indicating a state of the input in a previous step, and a timer value;

(b) increment the first value;

(c) set the output to low if the output is high and the first value is greater than the fourth value;

(d) set the output to high and reset the first value if the output is low and the first value is greater than the second value;

(e) reset the fifth value and set the sixth value to low if the sixth value is high and a present state of the input is low;

(f) if the sixth value is low, increment the fifth value, and further if the present state of the input is high, update the fourth value based on the fifth value and set the sixth value to high; and (g) reset the timer value and repeat acts (b) to (g) if the timer value has exceeded the third value.

10. The dimming ballast apparatus of claim 9 wherein, in act (f), the microcontroller updates the fourth value to a first constant for a lower range of the fifth value, to a linearly-decreasing function of the fifth value for an intermediate range of the fifth value, and to a second constant for an upper range of the fifth value.

11. A method comprising:

generating a pulse width modulated signal based on a firing angle of a powering signal from a power-line phase angle dimmer control, wherein the firing angle of each half cycle of the powering signal from the power-line phase angle dimmer control is less than or equal to 30 degrees;

generating a dimming command signal based on the pulse width modulated signal; and dimming a lamp based on the dimming command signal.

12. The method of claim 11 wherein the firing angle is less than or equal to 25 degrees.

13. The method of claim 11 wherein the firing angle is less than or equal to 20 degrees.

14. The method of claim 11 further comprising:

generating a pulsed firing angle signal based on the powering signal, wherein the pulse width modulated signal is generated based on the pulsed firing angle signal.

15. The method of claim 14 wherein said generating the pulse width modulated signal comprises:

determining a duration of a portion of the pulsed firing angle signal; and generating the pulse width modulated signal having a pulse width based on the duration.

16. The method of claim 15 wherein the duration is of a low period of the pulsed firing angle signal.

17. The method of claim 16 wherein the pulse width is inversely related to the duration.

18. The method of claim 14 wherein said generating the pulse width modulated signal comprises:

(a) initializing a first value for counting a number of steps in an output period, a second value for determining when to initiate a subsequent output period, a third value for representing a number of instruction cycles per step, a fourth value for indicating a number of steps that the pulse width modulated signal is to be high, a fifth value for counting a number of steps that the pulsed firing angle signal is high, a sixth value for indicating a state of the pulsed firing angle signal in a previous step, and a timer value;

(b) incrementing the first value;

(c) setting the pulse width modulated signal to low if the pulse width modulated signal is high and the first value is greater than the fourth value;

(d) setting the pulse width modulated signal to high and resetting the first value if the pulse width modulated signal is low and the first value is greater than the second value;

(e) resetting the fifth value and setting the sixth value to low if the sixth value is high and a present state of the pulsed firing angle signal is low;

(f) if the sixth value is low, incrementing the fifth value, and further if the present state of the pulsed firing angle signal is high, updating the fourth value based on the fifth value and setting the sixth value to high; and (g) resetting the timer value and repeating acts (b) to (g) if the timer value has exceeded the third value.

19. The method of claim 18 wherein, in act (f), the fourth value is updated to a first constant for a lower range of the fifth value, to a linearly-decreasing function of the fifth value for an intermediate range of the fifth value, and to a second constant for an upper range of the fifth value.

* * * * *